US006502882B2

(12) United States Patent
Snider et al.

(10) Patent No.: US 6,502,882 B2
(45) Date of Patent: Jan. 7, 2003

(54) HANDLE FOR STORAGE BAG

(75) Inventors: Gregory Scott Snider, Bel Air, MD (US); James Pangerc, Parkville, MD (US); Matthew J. Holland, Baltimore, MD (US)

(73) Assignee: Black & Decker, Inc., Newark, DE (US)

( * ) Notice: Subject to any disclaimer, the term of this patent is extended or adjusted under 35 U.S.C. 154(b) by 0 days.

(21) Appl. No.: 09/909,134

(22) Filed: Jul. 19, 2001

(65) Prior Publication Data

US 2002/0033612 A1 Mar. 21, 2002

Related U.S. Application Data

(60) Provisional application No. 60/222,415, filed on Aug. 2, 2000.

(51) Int. Cl.[7] ..... B65D 33/06

(52) U.S. Cl. ..... 294/152; 383/6; 383/17

(58) Field of Search ..... 294/149, 152, 294/157, 74; 383/6–8, 17, 18, 24; 190/117; 16/410

(56) References Cited

U.S. PATENT DOCUMENTS

| | | | | |
|---|---|---|---|---|
| 1,251,404 A | | 12/1917 | Mills | |
| 1,359,461 A | | 11/1920 | Luce | |
| 2,502,486 A | | 4/1950 | Savrin | |
| 4,140,164 A | | 2/1979 | Staup | |
| 4,239,271 A | * | 12/1980 | Beasley et al. | 294/74 |
| 4,703,517 A | | 10/1987 | Marino | |
| 4,836,374 A | | 6/1989 | Hutchins et al. | |
| 5,192,133 A | * | 3/1993 | Juel et al. | 383/109 |
| 5,328,267 A | * | 7/1994 | Cuddy et al. | 383/105 |
| 5,653,337 A | | 8/1997 | Cirigliano | |
| 5,813,445 A | | 9/1998 | Christman | |

* cited by examiner

*Primary Examiner*—Dean J. Kramer
(74) *Attorney, Agent, or Firm*—Harnes, Dickey & Pierce, P.L.C.

(57) ABSTRACT

A handle and strap for use with a tool storage bag is disclosed. The handle is uniquely formed into the strap and is made for carrying heavy loads. The strap includes first and second ends each including a first and a second leg. The first leg is folded generally in half over itself and placed within and affixed to the second leg which is also folded generally in half over itself to form an overlap. A covering material is wrapped around the overlap.

7 Claims, 3 Drawing Sheets

Figure - 4a
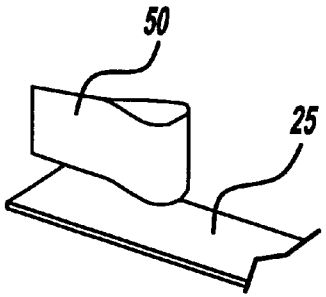
Figure - 4b
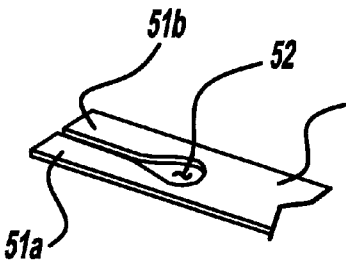
Figure - 4c
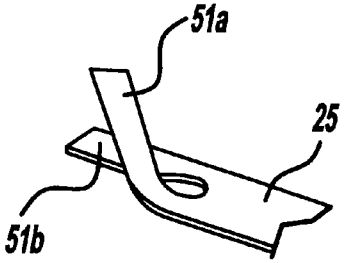
Figure - 4d
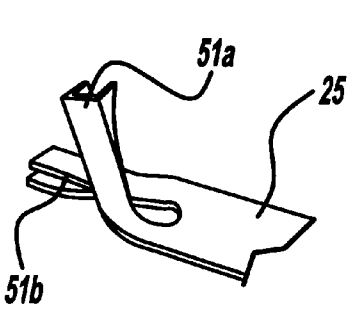
Figure - 4e
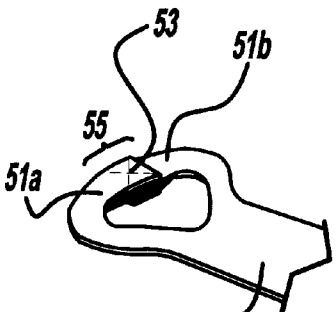
Figure - 4f
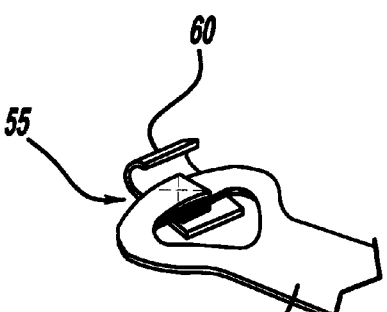
Figure - 4g
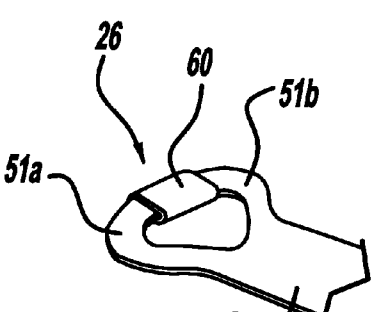
Figure - 4h

HANDLE FOR STORAGE BAG

FIELD OF THE INVENTION

The present invention relates generally to handles for bags and more particularly to a heavy duty handle formed integrally with the strap to which it is attached.

BACKGROUND

It is known in the art to create handles that are placed upon various types of bags for ease of transport. Handles generally include a strap with a handle in association therewith for insertion of a hand. Generally, the art has attempted to create strong handles that are designed to withstand a great weight that has been placed in the bag to which the handles are attached. However, these handles still have shortfalls.

Many handles in the art are formed through looping a strap and providing a space for a hand in that manner. This design requires a greater amount of strap material in order to provide a strong handle that loops about the entire bag. Furthermore, if this method does not surround the entire bag then the handles are generally stitched to the sides of the bag. This stitching either provides a weak handle-to-bag connection, or requires a substantial portion of stitching to securely hold the strap to the bag.

Other methods of handle formation include forming an opening within the strap material. The handle opening is formed by cutting a portion of the strap material away to create an opening. Again, to ensure a strong handle a vast amount of material is required.

Another final type of handle is formed through connecting a portion of an end of a strap together. This handle type of handle is disclosed in U.S. Pat. No. 4,703,517. However, this disclosure requires that a bag and handle be formed together, essentially a unitary portion of material is used for the handle and the bag. Furthermore, the material is on a continuous reel that provides for only one bag design and type.

SUMMARY OF THE INVENTION

It is an object of the present invention to provide a handle to a storage bag that will withstand a heavy load and still provide comfort for the user.

It is a second object of the present invention to provide a handle formed from a strap that surrounds the bag to increase the weight capacity of the handle and to more equally distribute the weight of the bag.

It is still another object of the present invention to provide a handle which is simple to manufacture and refined in appearance.

The present invention uniquely forms a handle from the strap to which the handle is attached. In this way the handle need not be attached to the strap that surrounds the bag, but rather is a part of the strap. Thus, the handle is of a more solid construction and will not be susceptible to such wear and breakage as other handles may experience.

BRIEF DESCRIPTION OF THE DRAWINGS

The present invention will become more fully understood from the detailed description and the accompanying drawings, wherein:

FIG. 4 is a preferred method of construction of the handle according to the present invention.

DETAILED DESCRIPTION OF THE PREFERRED EMBODIMENTS

Figure 1:
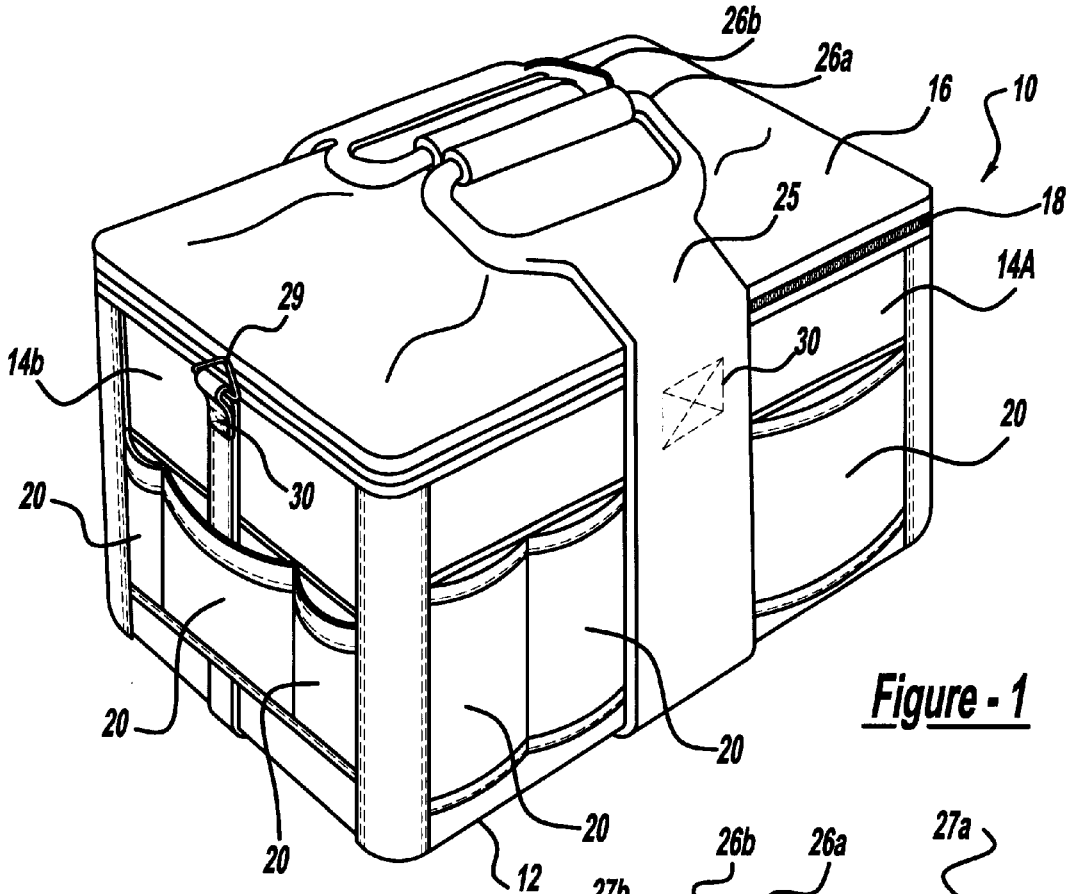
FIG. 1 is a perspective view of a tool storage bag which incorporates the handle according to the present invention.
Figure 2:
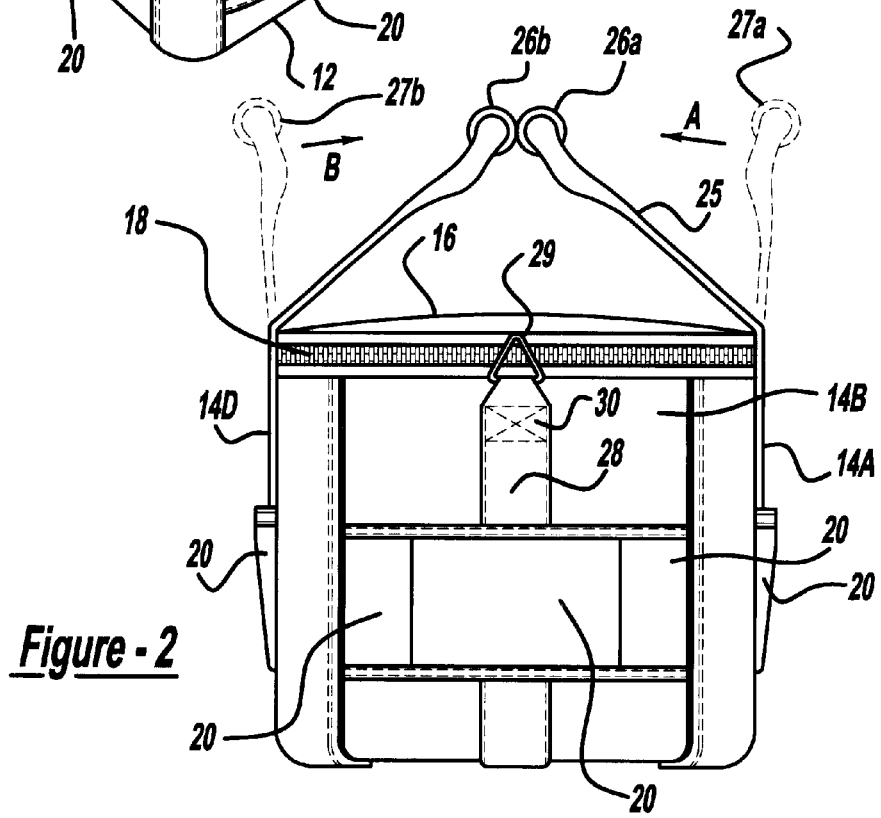
FIG. 2 is an end view of the tool storage bag according to the present invention.
Figure 3:
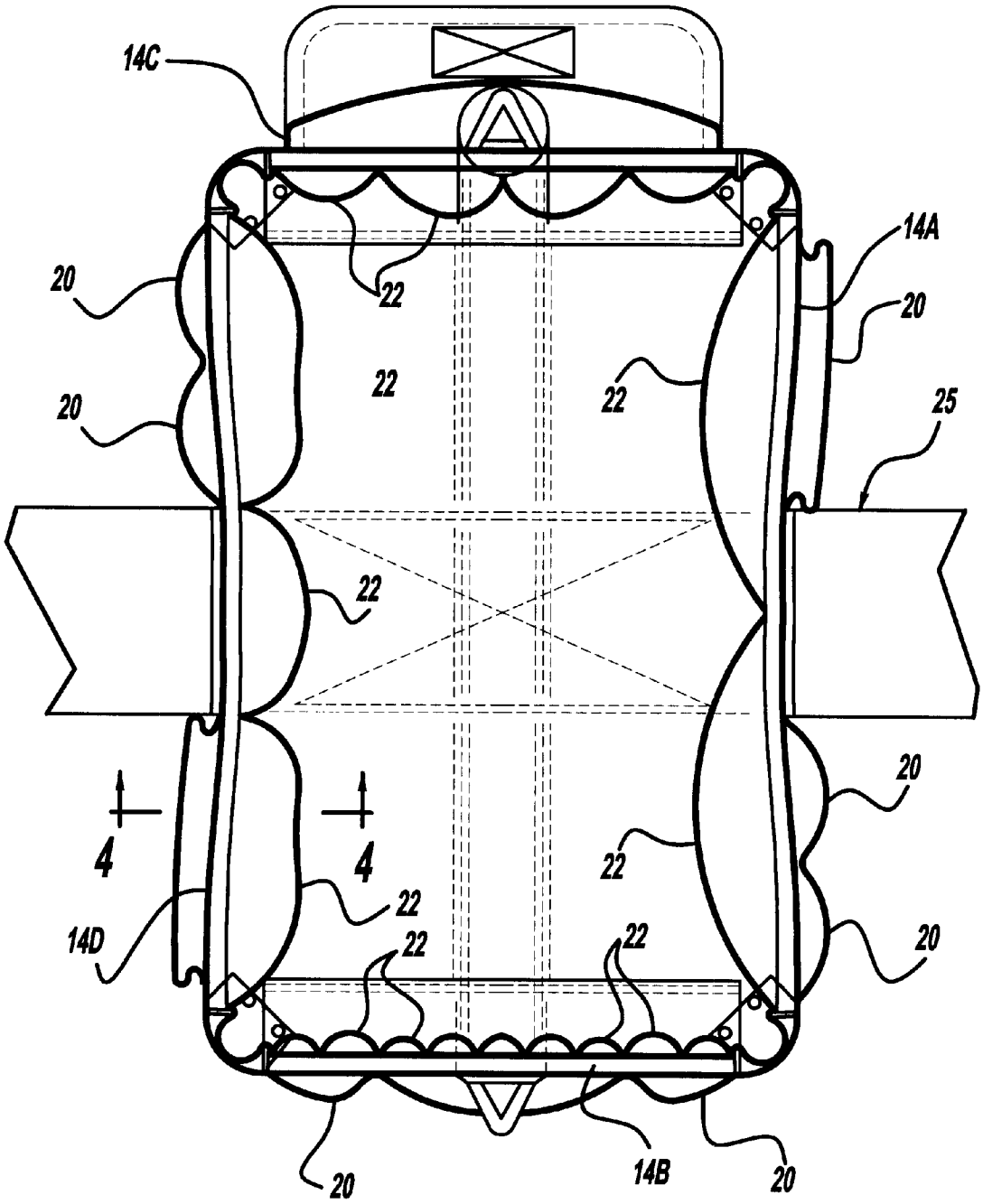
FIG. 3 is a plan view of the interior of the tool storage bag according to the present invention including a cross-sectional view of side pockets of the worksite storage bag according to the present invention.

A tool storage bag 10, as is illustrated in FIGS. 1–3, includes a base 12 and generally vertical sidewalls 14A–14D which are formed of a ballistic nylon inner and outer shell having open cell urethane disposed therebetween. A cover 16 is attached to the sidewall 14D by a fabric hinge. A zipper 18 is provided along sidewalls 14A–14C for securing the cover 16 in a closed position. The storage bag 10 is designed for storing tools and accessories and includes a plurality of exterior pockets 20 disposed on the exterior surface and an additional plurality of interior pockets 22 (shown in FIG. 3) disposed on an interior surface of the sidewalls 14A–14D. The pockets 20,22 are formed through stitching material to the sidewalls 14A–14D. The sidewalls 14A–14D are spaced a distance apart so as to create a large footprint of the tool storage bag 10. This large footprint allows for the storage of numerous tools and accessories of various sizes which are not currently accommodated by other storage bags. Furthermore, the pockets 20,22 allow for further storage of tools and their attendant accessories.

The tool storage bag 10 additionally includes a first leather strap portion 25 that extends along sidewall 14A, the base 12 and sidewall 14D. The first leather strap 25 terminates in uniquely designed handles 26*a,* 26*b* (as shown in FIGS. 1 and 2), described below. A second leather strap 28 extends from sidewalls 14B, the base 12 and sidewall 14C and crosses the first leather strap 25 below the base 12. The second leather strap 28 terminates at both ends in metal loops 29 which are designed to be engaged by a shoulder strap (not shown). The ends of leather straps 25,28 are stitched to the sidewalls by a boxstitch 30 and provide even weight distribution for ease of transport and storage. The leather straps 25,28 in traversing, as one piece, the entire distance around the storage bag 10 ensure that the weight of the worksite storage bag 10 is not shifted unevenly.

With continuing reference to FIG. 1 and particular reference to FIG. 2 the unique handles 26*a,* 26*b* may be seen. The handles 26*a,* 26*b* have hook-and-loop fasteners 27*a,* 27*b* on the innermost sides for attaching the handles 26*a,* 26*b* together when carrying or storing the worksite storage bag 10. The handles 26*a,* 26*b* may be fastened together by moving handle 26*a* in the direction of Arrow A and handle 26*b* in the direction of Arrow B to allow the hook-and-loop fasteners 27*a,* 27*b* to engage one another. Furthermore, having the handles 26*a,* 26*b* secured on top of the bag can increase safety at a work site and during transport.

Turning reference to FIGS. 4A–4H the preferred embodiment for constructing the handles 26*a,*26*b* is illustrated through several steps. Initially the end of the first leather strap 25 is laid flat as illustrated in FIG. 4A. Next, FIGS. 4B–4C indicate, a die 50 is used to cut the end of the first leather strip 25 into two legs 51*a* and 51*b* and creating an opening 52 through the leather strap 25. Following creating the legs 51*a,*51*b,* FIGS. 4D–4E indicate the legs 51*a,*51*b* being folded in half upon themselves as shown particularly in FIG. 4E. FIG. 4F indicates the folded end of leg 51*b* is then placed within the folded end of leg 51*a* creating an overlap area 55 which is then stitched together 53. FIGS.

4G–4H indicate that there is a portion of leather or nylon weave 60 further placed over the overlapped area 55 and stitched closed to add further support and rigidity to the handle 26. In this way a strong and reinforced handle 26 is formed from the first leather strap 25.

A second embodiment (not shown) is very similar to the preferred embodiment. The only difference is that the first leather strap 25 is made of two pieces of leather adhered suede side together. The process of then forming the handle in the double leather strap would be substantially similar to that of the preferred embodiment. In this way the top grain leather side may be on both sides of the strap and handle. Furthermore, the existence of two straps would increase the weight capacity of the strap and the handle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A method for making a handle adapted to be attached to a bag comprising the steps of:

forming a length of strap with generally parallel sides along its length;

cutting an end of said strap to form a first and a second leg;

folding said first leg over itself, substantially in half, and folding said second leg substantially in half around said first leg to form an overlap; and affixing said legs together.

2. The method of claim 1, comprising the further step of placing an additional piece of material around said overlap of said legs.

3. The method of claim 2, wherein said additional piece of material is a nylon weave which is sewn together over said overlap.

4. The method of claim 1, wherein said legs are sewn together.

5. A strap and a handle adapted for carrying a bag comprising:

a strap having a first and second end;

said first and second ends each including a first and second leg said first leg being folded generally in half over itself and placed within and affixed to said second leg also being folded generally in half over itself to form an overlap; and a covering material wrapped around said overlap.

6. The strap and handle of claim 5, wherein said covering material is a nylon weave which is sewn together over said overlap.

7. The strap and handle of claim 5, wherein said overlap is affixed by stitching.

* * * * *